US007806997B2

(12) United States Patent
Demetriou et al.

(10) Patent No.: US 7,806,997 B2
(45) Date of Patent: Oct. 5, 2010

(54) AMORPHOUS FE AND CO BASED METALLIC FOAMS AND METHODS OF PRODUCING THE SAME

(75) Inventors: Marios D. Demetriou, Los Angeles, CA (US); Gang Duan, Chandler, AZ (US); William L. Johnson, Pasadena, CA (US); Chris Veazey, Pasadena, CA (US)

(73) Assignee: California Institute of Technology, Pasadena, CA (US)

( * ) Notice: Subject to any disclaimer, the term of this patent is extended or adjusted under 35 U.S.C. 154(b) by 114 days.

(21) Appl. No.: 11/850,582

(22) Filed: Sep. 5, 2007

(65) Prior Publication Data

US 2008/0118387 A1 May 22, 2008

Related U.S. Application Data

(60) Provisional application No. 60/842,618, filed on Sep. 5, 2006.

(51) Int. Cl.
*B22F 3/02* (2006.01)

(52) U.S. Cl. ..... 148/561

(58) Field of Classification Search ..... None
See application file for complete search history.

(56) References Cited

U.S. PATENT DOCUMENTS

| | | | | |
|---|---|---|---|---|
| 3,214,265 | A * | 10/1965 | Fiedler | 75/415 |
| 5,288,344 | A | 2/1994 | Peker et al. | |
| 5,735,975 | A | 4/1998 | Lin et al. | |
| 6,713,519 | B2 | 3/2004 | Wang et al. | |

OTHER PUBLICATIONS

Irretier et al., Lead and lead alloy foams; Acta Materialia 53 (2005), pp. 4903-4917.

International Search Report and Written Opinion dated Feb. 20, 2008 for PCT Application No. PCT/US 07/19412, 9 sheets, indicating relevance of listed references in this IDS.

* cited by examiner

*Primary Examiner*—Roy King
*Assistant Examiner*—Yoshitoshi Takeuchi
(74) *Attorney, Agent, or Firm*—Christie, Parker & Hale, LLP

(57) ABSTRACT

Amorphous Fe-based metal foams and methods of preparing the same are provided. The Fe-based foams are prepared from Fe-based metal alloys of low hydrogen solubility having an atomic fraction of Fe greater than or equal to the atomic fraction of each other alloying element. A method for producing the Fe-based foams includes the in situ decomposition of a hydride in a molten Fe-based alloy.

15 Claims, 4 Drawing Sheets

FIG. 4a
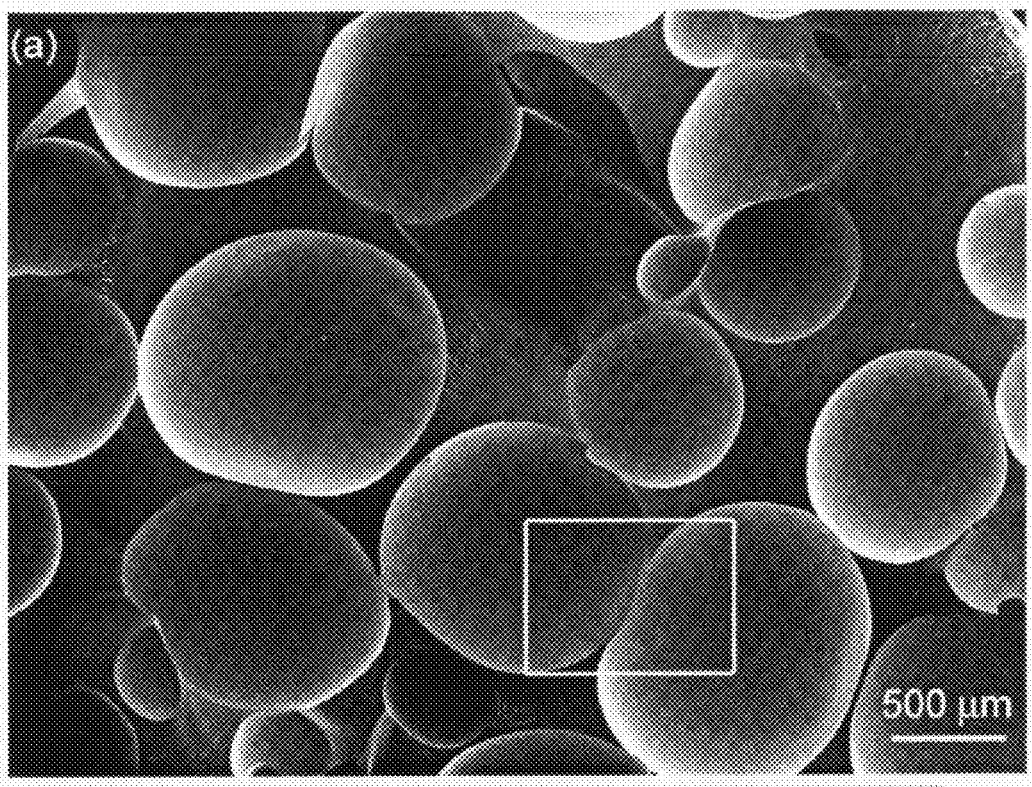
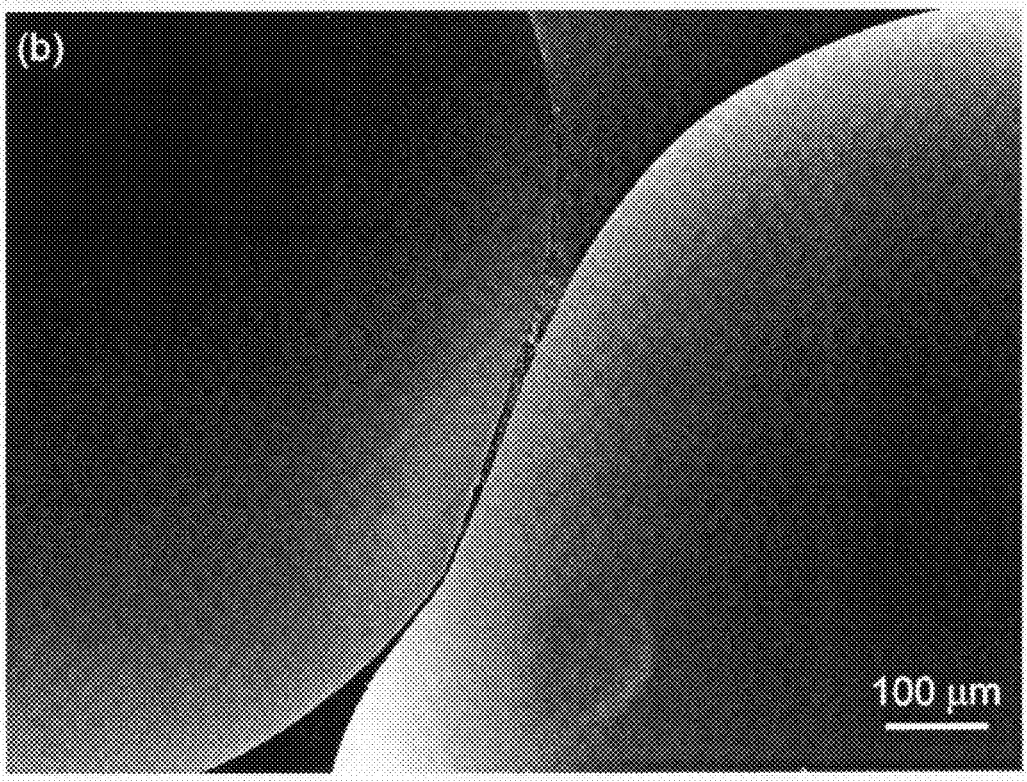
FIG. 4b

AMORPHOUS FE AND CO BASED METALLIC FOAMS AND METHODS OF PRODUCING THE SAME

CROSS-REFERENCE TO RELATED APPLICATION(S)

This application claims priority to and the benefit of U.S. Provisional Application Ser. No. 60/842,618, filed on Sep. 5, 2006 and titled "METHOD OF PRODUCING AMORPHOUS STEEL FOAM," the entire content of which is incorporated herein by reference.

BACKGROUND OF THE INVENTION

Crystalline Fe- and Co-based foams are known and have been produced using known methods, such as generating gas bubbles, powder metallurgy, etc. However, the molten states of crystalline metallic alloys exhibit rather low viscosities, typically on the order of $10^{-3}$ Pa-s. Consequently, efforts to produce crystalline metal foams by generating gas bubbles are severely hindered by the tendency of bubbles to sediment. Powder metallurgical routes may also be used, which involves bubble generation within a powder matrix of the metal. These routes improve the overall homogeneity of the porous product. Other methods are also used for reducing bubble sedimentation. One such method involves the introduction of stabilizing substances into the melt. Another method involves the generation of bubbles in the semi-solid state.

FIELD OF THE INVENTION

The present invention is directed to amorphous Fe- and Co-based metallic foams and to methods of preparing the same.

SUMMARY OF THE INVENTION

In one embodiment of the present invention, amorphous Fe- and Co-based metal foams are provided. In contrast to the molten state properties of the crystalline metal alloys, the molten states of amorphous Fe- and Co-based forming alloys exhibit excessively high viscosities, estimated to range from about 10 to about 100 Pa s, i.e. approximately four to five orders of magnitude greater than those of conventional steel melts. Such high viscosity melts naturally inhibit bubble sedimentation, and are suitable for the production of uniform and homogeneous porous structures. Moreover, the excessively low solubility of hydrogen in amorphous Fe- and Co-based alloys, which is attributed to the non-hydride forming elements of those alloys, makes these alloys suitable for foaming using hydrogen releasing agents. These factors, combined together, render Fe- and Co-based glass forming alloys attractive materials for foam synthesis.

The Fe- or Co-based metal foams are prepared from base solids of a Fe- or Co-based metallic alloy composition. The alloy composition has low hydrogen solubility and can form a vitrified amorphous state in bulk dimensions (i.e., greater than 1 mm). In addition, the alloy composition includes an atomic fraction of either Fe or Co that is equal to or greater than the atomic fraction of each of the other components.

According to one embodiment, a method of producing the Fe- or Co-based foams includes introducing a hydride powder into the molten state of a Fe- or Co-based alloy. The mixture is held in an inert gas atmosphere, and is brought to a temperature and pressure at which the hydride decomposes to release hydrogen gas, which becomes entrained in the liquid in the form of gas bubbles. The decomposed solid/liquid residue blends with the molten alloy. The two-phase mixture is subsequently quenched to render the solidified porous product amorphous.

BRIEF DESCRIPTION OF THE DRAWINGS

The above features and advantages of the present invention will be better understood by reference to the following detailed description when considered in conjunction with the attached drawings in which:

FIGS. 4*a* and 4*b* depict scanning electron micrographs at different magnifications of the cellular morphology of an amorphous $Fe_{48}Cr_{15}Mo_{14}Y_2C_{15}B_6$ steel foam.

DETAILED DESCRIPTION OF THE INVENTION

Figure 1:
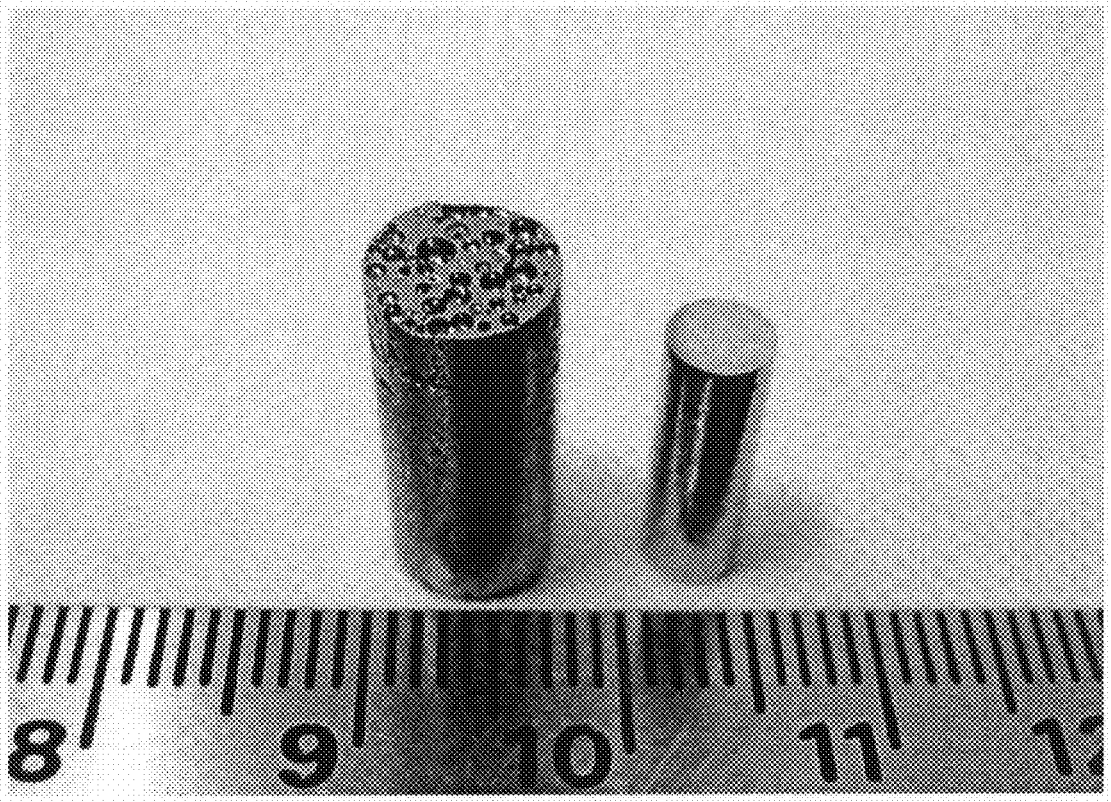
FIG. 1 is a photograph of the amorphous $Fe_{48}Cr_{15}Mo_{14}Y_2C_{15}B_6$ steel foam prepared according to Example 1.

Recently, new classes of Fe- and Co-based bulk-glass formers have been discovered capable of forming glasses at a low cooling rate of less than $10^3$ K/s. These glass formers can form glasses having critical casting thicknesses exceeding 1 cm. The glass forming ability of these systems has been attributed to a kinetically "strong" liquid state effectively retarding the kinetics and facilitating configurational freezing. Judging from the distribution of atomic radii making up the composition of these glass formers, the stability (or strength) of their liquid structure should be rather high, or equivalently, the fragility should be rather low, in accordance with the phenomenological hypothesis of confusion principle.

Low liquid fragility can also be expected by considering the low Poisson's ratio of these alloys, as fragility and Poisson's ratio are correlated. Even though no viscosity measurements for this glass forming liquid have been reported to date, a reasonable estimate for the liquid fragility can be made by considering the alloy's Poisson's ratio. The measured Poisson's ratio is about 0.3. From the measured Poisson's ratio, a fragility value of approximately 30 can be predicted. This value is relatively low compared to other fragile metallic glass forming liquids. For instance, the fragility of Pd-based liquids is reported to be about 60, which is a factor of 2 greater than the predicted fragility for these Fe-based liquids.

A new relationship between viscosity $\eta$ and fragility m has recently been proposed as $\ln(\eta)\sim(T_g/T)^{m/16.4}$ (where $T_g$ is the glass-transition temperature). Using this relationship, the viscosity of the Fe-based glasses can be estimated at $T=2T_g$ to be greater than that of Pd-based glasses by a factor of $\exp[(1/2)^{(30-60)/16.4}]$,i.e. by a factor of about 35. Therefore, at high temperatures, these strong liquids can be expected to be considerably more viscous than fragile metallic glass forming liquids.

Aside from being very strong, these liquids can be expected to exhibit a rather low solubility of hydrogen. Since none of the main constituent metals in the compositions of these Fe-based glass formers form stable hydrides (i.e. Fe, Mn, Mo, and Cr), the chemical potential of hydrogen in the alloy is expected to be considerably high, resulting in particularly low solubility limits. Indeed, for a different class of Fe-based glass formers, which also contain non-hydride forming elements, the hydrogen solubility limits at 1-atm pressure and temperature of 100° C. have been shown to be remarkably low (i.e., on the order of 10 ppm). In fact, even for Fe-based glass formers containing nickel, which is a modest hydride former, the hydrogen solubility limits under the same temperature and pressure conditions have been found to be less than 50 ppm.

According to embodiments of the present invention, hydrogen is introduced into these liquids at high temperatures, where hydrogen solubility is low, and nearly all hydrogen precipitates in the form of gas bubbles. In one embodiment, for example, a decomposing hydride phase is introduced within these melts, resulting in a uniform dispersion of hydrogen bubbles within the liquid matrix. The melt's high viscosity effectively constrains bubble sedimentation, and minute additions of a base metal into the alloy composition does not erode the alloy's glass forming ability, which gives rise to a natural foaming process that enables production of amorphous Fe- and Co-based foams. Accordingly, one embodiment of the present invention provides amorphous Fe- and Co-based foams produced via in situ decomposition of a hydride in a high-temperature liquid alloy composition.

The base solids of the Fe- and Co-based foams according to embodiments of the present invention may be any Fe- or Co-based metallic glass forming alloy composition with low hydrogen solubility that can form a vitrified amorphous state in bulk dimensions (i.e., greater than 1 mm), and that includes an atomic fraction of either Fe or Co that is equal to or greater than the atomic fraction of each of the other components. For example, the atomic fraction of Fe or Co is about 20 or greater. In one embodiment, the alloy composition contains elements which form no stable hydrides or only marginally stable hydrides such that the alloy has a solubility of hydrogen at atmospheric pressure and ambient temperature of less than about 500 ppm. Nonlimiting examples of suitable alloy compositions include Fe—Cr—Mo—(Y,Ln)-C-B alloy compositions (where Ln=lanthanides), Co—Cr—Mo-Ln-C-B alloy compositions, Fe—Mn—Cr—Mo—(Y,Ln)-C-B alloy compositions, (Fe,Cr,Co)-(Mo,Mn)-(C,B)-Y alloy compositions, Fe—(Co,Ni)-(Zr,Nb,Ta)-(Mo,W)-B alloy compositions, Fe—(Al,Ga)-(P,C,B,Si,Ge) alloy compositions, Fe—(Co,Cr, Mo,Ga,Sb)-P-B-C alloy compositions, (Fe,Co)-B—Si—Nb alloy compositions, and Fe—(Cr—Mo)-(C,B)—Tm alloy compositions. As used herein, elements appearing in parentheses indicate that the alloy includes at least one of the elements in the parentheses, a combination of elements in the parentheses, or all of the elements in the parentheses. One specific, nonlimiting example of a suitable alloy composition is $Fe_{48}Cr_{15}Mo_{14}Y_2C_{15}B_6$.

According to another embodiment, a method of producing the Fe- or Co-based foams includes introducing a hydride powder (as a hydrogen releasing agent) into the molten state of a Fe- or Co-based alloy. The agent to alloy mass ratio may be any suitable value, for example, up to and including 99%. In one embodiment, the agent to alloy mass ratio may range from about 1% to about 5%. The mixture is held in an inert gas atmosphere for from about 30 to about 60 seconds, and is brought to a temperature and pressure at which the hydride decomposes to release hydrogen gas, which becomes entrained in the liquid in the form of gas bubbles. In embodiments using $ZrH_2$, the pressure may be about 1.5 atm, and the temperature may range from about 1400 to about 1500° C. The decomposed solid/liquid residue blends with the molten alloy to form a two-phase mixture. The two-phase mixture is subsequently quenched to render the solidified porous product amorphous.

In one embodiment, the hydride powder is introduced as a bed onto which a solid ingot of the Fe- and Co-based glass forming alloy is laid, which is subsequently melted. In another embodiment, the hydride powder is poured and stirred into the molten Fe- and Co-based glass forming alloy. In yet another embodiment, the hydride powder is blended with solid particulates of the alloy and compacted to form a consolidated precursor, which is subsequently melted.

The hydride powder used in the method may be any metal-based, metalloid-based, or lanthanide-based hydride compound capable of being combined with the Fe- and Co-based glass forming alloy without significantly affecting the alloy's vitrifying ability. For example, any hydride compound may be used that reduces the fraction of the amorphous phase in the solid region of the final porous product by less than about 50%. In one embodiment, the hydride compound is a metal-based hydride that will not erode the alloy's glass forming ability, and that decomposes at a temperature close to the alloy melting point. Nonlimiting examples of suitable hydride compounds include Zr hydrides, Ti hydrides, Mg hydrides, V hydrides, Sc hydrides, Zn hydrides, Y hydrides, Cd hydrides, Hf hydrides, Ta hydrides, Pd hydrides, La hydrides, Ce hydrides, Al hydrides, Ga hydrides, Ge hydrides, B hydrides and combinations thereof. One exemplary hydride compound is zirconium hydride ($ZrH_2$). $ZrH_2$ begins slowly evolving hydrogen when heated above about 600° C., thus forming zirconium hydride phases of lower hydrogen content which ultimately massively decompose into $H_2$ and $\alpha$-Zr at temperatures well above 1000° C.

The inventive foam synthesis method takes advantage of the viscous high-temperature liquid state of Fe- and Co-based bulk-glass forming alloys to produce amorphous Fe- and Co-based foams. In one embodiment, zirconium hydride is used as the foaming agent, taking advantage of the low hydrogen solubility of the Fe- and Co-based glass-forming alloys. According to certain embodiments of the method, amorphous foams with porosities up to and including 99% can be produced. In one embodiment, for example, amorphous foams with porosities up to and including 65% can be produced having homogenous cellular morphologies that exhibit cell-size uniformity.

The following example is presented for illustrative purposes only, and is not intended to limit the scope of the present invention. In the Example, a $Fe_{48}Cr_{15}Mo_{14}Y_2C_{15}B_6$ glass forming alloy was employed for foam processing. The glass transition and liquidus temperatures of this alloy are 575° C. and about 1150° C., respectively, and the critical casting thickness is 9 mm.

Zirconium hydride ($ZrH_2$) was used as the foaming agent. In situ decomposition of hydride phases within the liquid phase evolves hydrogen, which precipitates out of the liquid in the form of uniformly dispersed micro-bubbles. However, the decomposed zirconium (which in small quantities has a negligible effect on the alloy glass-forming ability) remains dissolved in the alloy composition. The high liquid viscosity inhibits sedimentation of the evolved micro-bubbles.

The two-phase mixture is quenched at a rate higher than the critical cooling rate of the alloy, resulting in a glassy porous structure. Due to the detrimental effect of pores on thermal conduction, the casting thickness (to render the porous solid amorphous) is somewhat lower than the critical casting thickness required to obtain a pore-free glass.

Example 1

Alloy ingots of $Fe_{48}Cr_{15}Mo_{14}Y_2C_{15}B_6$ were prepared by melting the appropriate amounts of Fe (99.9%), Cr (99.99%), Mo (99.9%), Y (99.9%), C (99.99%), and B (99.9%) in an arc furnace under argon atmosphere. Commercial-grade $ZrH_2$ powder (99.9% purity, <44 μm) was used as the hydrogen releasing agent. The agent to alloy mass ratio (which to some extent determined the final product porosity) was varied between 1% and 5%. The critical copper-mold casting thickness of the pore-free alloy is 9 mm. Because quartz-tube water quenching as well as the presence of pores in the liquid would result in a lower cooling rate than copper-mold casting of a pore-free glass, 7-mm ID quartz tubes were employed to ensure that the product would be rendered amorphous by quenching.

The alloy ingot was set on a bed of agent powder and heated inductively in the quartz tube under argon. The ambient pressure (which to some extent controlled the average pore size) was 1.5 atm. The melt temperature during processing was monitored using an infra-red pyrometer. Upon heating, a temperature plateau between about 1100 and 1200° C. was observed, immediately followed by a rather steep increase in temperature that led to a second plateau between about 1400 and 1500° C. The endothermic reaction designated by the lower temperature plateau is consistent with the melting of the alloy. The steep increase in temperature following the first plateau designates an exothermic reaction, which is believed to be the mixing of the zirconium hydride phases in the alloy. The higher temperature plateau is believed to be associated with the in situ decomposition of the zirconium hydride phases within the melt, since such decomposition reaction is known to be endothermic. After allowing a 30 to 60 second settling time at the high temperature plateau, the two-phase mixture was rapidly water quenched.

According to Example 1, amorphous foams having porosities as high as 65% were produced. Porosities were measured using the Archimedes method. One amorphous foam produced according to Example 1 and having a 58% porosity is shown in FIG. 1. The amorphous foam shown in FIG. 1 is a $Fe_{48}Cr_{15}Mo_{14}Y_2C_{15}B_6$ foam obtained using a 5% agent-to-alloy mass ratio. A pore-free $Fe_{48}Cr_{15}Mo_{14}Y_2C_{15}B_6$ rod of equivalent mass is also shown in FIG. 1 to demonstrate the nearly three-fold increase in volume produced by foaming.

Figure 2:
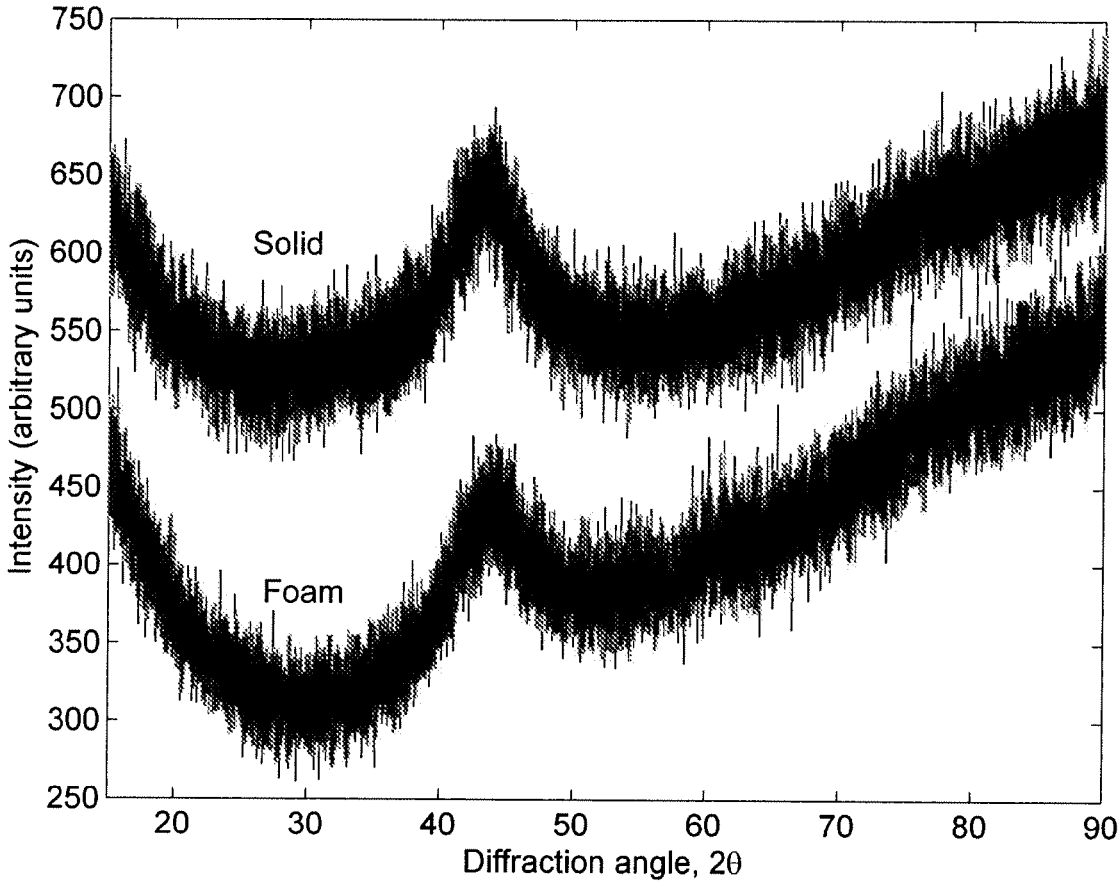
FIG. 2 depicts x-ray diffractograms of the monolithic alloy and the foam.

X-ray diffraction analysis was performed on an axial cross section of the foam depicted in FIG. 1. A Siemens D500 diffractometer using Cu Kα radiation was used. The diffractograms are shown in FIG. 2, and verify the amorphous nature of both the monolithic solid and the foam.

Figure 3:
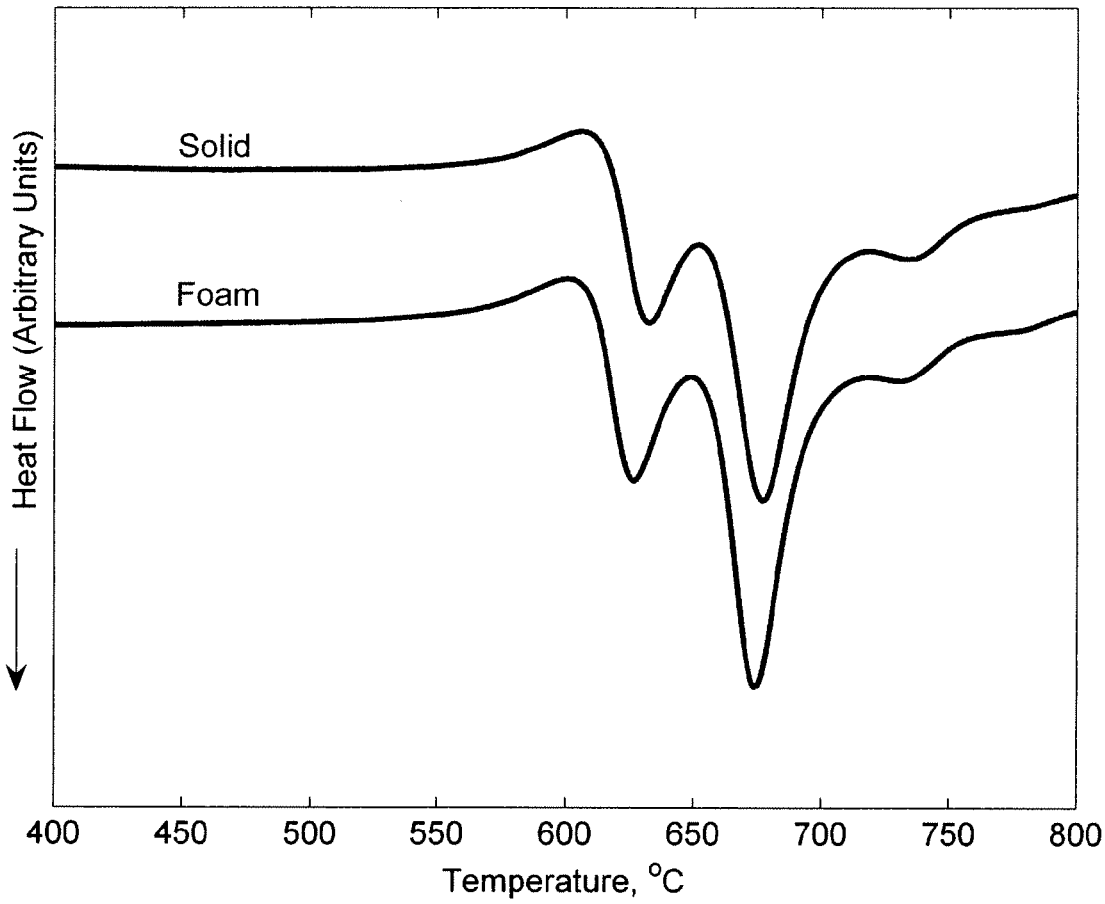
FIG. 3 depicts differential scanning calorimetry scans of the monolithic alloy and the foam.

Differential scanning calorimetry tests were performed on a small segment of the foam taken from near the centerline of the foam. A Netzch DSC 404C was used at a scan rate of 20K/min. The scans of the monolithic solid and the foam are shown in FIG. 3. As shown in the scans depicted in FIG. 3, no notable changes in the thermodynamic characteristics of the amorphous state are induced by foaming. In particular, it is evident from the scans that the minute addition of decomposed Zr in the alloy composition did not alter the thermodynamic characteristics of the amorphous state.

The morphology of the closed-cell cellular structure was examined by scanning electron microscopy using a LEO 1550VP Field Emission SEM. The scanning electron micrographs were taken from an axial cross section of the foam and are shown in FIGS. 4*a* and 4*b*. The micrograph depicted in FIG. 4*a* was taken at a relatively low magnification, and demonstrates that the cellular structure exhibits good bubble size uniformity. The micrograph depicted in FIG. 4*b* was taken at a higher magnification, and illustrates the presence of a micrometer-size membrane. Thus, FIG. 4*b* shows that the inventive method can produce micro-scale cellular features.

As shown in FIG. 4*a*, the cellular morphology is fairly homogeneous, exhibiting cell-size uniformity. Moreover, as indicated by inspection of the foam axial cross section, cell-size variations along the gravity axis were rather small. The evolution dynamics of the pore size distribution during foaming are rather complex, as they depend on the kinetics of pore nucleation and growth, and on the dynamics of pore sedimentation, all of which scale inversely with viscosity. It is therefore reasonable to attribute the development of such uniform and homogeneous cellular morphology to the high liquid viscosity, which effectively "dampens" pore growth during foaming and adequately suppresses pore sedimentation.

Another interesting feature of the cellular structure is the existence of remarkably thin intracellular membranes evolved during foaming. As shown in FIG. 4*b*, intracellular solid regions as thin as a few micrometers are detected. These slender intracellular membranes were produced by the extensive plastic stretching realized during bubble growth as a consequence of the viscosity being Newtonian (i.e. strain-rate insensitive) at the foaming temperature.

In use, the metallic glass foam may have dimensions below the plastic zone thickness of the foam material. For example, the metallic glass foams may be struts with dimensions thinner than the material plastic zone thickness. Such struts may be capable of evading catastrophic fracture upon loading and may be able to undergo extensive plastic deformation.

While the present invention has been illustrated and described with reference to certain exemplary embodiments, those of ordinary skill in the art understand that various modifications and changes may be made to the described embodiments without departing from the spirit and scope of the present invention as defined by the following claims.

What is claimed is:

1. A method of making an amorphous metal foam, the method comprising:

providing a metallic glass forming alloy, the metallic glass forming alloy being Fe-based having at least one non-metal or metalloid alloying element and an atomic fraction of Fe equal to or greater than an atomic fraction of each other alloying element;

providing a hydride powder;

heating the metallic glass forming alloy to a temperature above its liquidus temperature, wherein the heating forms a molten mixture with the hydride powder;

holding the molten mixture in an inert gas atmosphere and bringing the molten mixture to a decomposition temperature and pressure at which decomposition temperature and pressure the hydride decomposes to release hydrogen gas; and quenching the mixture to produce a porous amorphous metal foam.

2. The method according to claim 1, wherein a mass ratio of the hydride to the metal alloy is up to about 99%.

3. The method according to claim 1, wherein a mass ratio of the hydride to the metal alloy ranges from about 1% to about 5%.

4. The method according to claim 1, wherein the hydride powder is poured into the molten metal alloy and stirred.

5. The method according to claim 1, wherein the hydride powder is blended with solid particulates of the metal alloy and compacted to form a consolidated precursor, wherein the precursor is subsequently melted.

6. The method according to claim 1, wherein the hydride is selected from the group consisting of metal-based, metalloid-based, and lanthanide-based hydride compounds that when combined with the metallic glass forming alloy reduces a fraction of amorphous phase in a solid portion of the amorphous metal foam by less than about 50%.

7. The method according to claim 1, wherein the hydride is selected from the group consisting of Zr hydrides, Ti hydrides, Mg hydrides, V hydrides, Sc hydrides, Zn hydrides, Y hydrides, Cd hydrides, Hf hydrides, Ta hydrides, Pd hydrides, La hydrides, Ce hydrides, Al hydrides, Ga hydrides, Ge hydrides, B hydrides and combinations thereof.

8. The method according to claim 1, wherein the hydride is $ZrH_2$.

9. The method according to claim 1, wherein the metal alloy has a hydrogen solubility at atmospheric pressure and ambient temperature of less than about 500 ppm.

10. The method according to claim 1, wherein the amorphous metal foam comprises a porosity of up to about 99%.

11. The method according to claim 1, wherein the amorphous metal foam comprises a porosity of up to about 65%.

12. The method according to claim 1, wherein the metallic glass forming alloy is Fe-based having an atomic fraction of Fe greater than about 20.

13. A method of making an amorphous metal foam, the method comprising:

providing a metallic glass forming alloy, the metallic glass forming alloy being Fe-based having at least one non-metal or metalloid alloying element and an atomic fraction of Fe equal to or greater than an atomic fraction of each other alloying element;

introducing a hydride powder as a bed onto which a solid ingot of the metal alloy is laid, wherein the solid ingot is subsequently melted;

heating the metallic glass forming alloy to a temperature above its liquidus temperature, wherein the heating forms a molten mixture with the hydride powder;

holding the molten mixture in an inert gas atmosphere and bringing the molten mixture to a decomposition temperature and pressure at which decomposition temperature and pressure the hydride decomposes to release hydrogen gas; and quenching the mixture to produce a porous amorphous metal foam.

14. A method of making an amorphous metal foam, the method comprising:

providing a metallic glass forming alloy in a molten state, the metallic glass forming alloy being $Fe_{48}Cr_{15}Mo_{14}Y_2C_{15}B_6$;

introducing a hydride powder into the molten metal alloy to provide a mixture;

holding the mixture in an inert gas atmosphere and bringing the mixture to a decomposition temperature and pressure at which decomposition temperature and pressure the hydride decomposes to release hydrogen gas; and quenching the mixture to produce a porous amorphous metal foam.

15. A method of making an amorphous metal foam, the method comprising:

providing a metallic glass forming alloy, the metallic glass forming alloy being an Fe-based alloy selected from the group consisting of Fe—Cr—Mo—(Y,Ln)-C-B alloys, Fe—Mn—Cr—Mo—(Y,Ln)-C-B alloys, (Fe,Cr)-(Mo, Mn)-(C,B)-Y alloys, Fe—(Ni)—(Zr,Nb,Ta)-(Mo,W)-B alloys, Fe—(Al,Ga)-(P,C,B,Si,Ge) alloys, Fe—(Cr,Mo, Ga, Sb)-P-B-C alloys, Fe—B—Si—Nb alloys, and Fe—(Cr—Mo)-(C,B)—Tm alloys;

providing a hydride powder;

heating the metallic glass forming alloy to a temperature above its liquidus temperature, wherein the heating forms a molten mixture with the hydride powder;

holding the molten mixture in an inert gas atmosphere and bringing the molten mixture to a decomposition temperature and pressure at which decomposition temperature and pressure the hydride decomposes to release hydrogen gas; and quenching the mixture to produce a porous amorphous metal foam.

* * * * *